US011662191B2

(12) United States Patent
Salois et al.

(10) Patent No.: US 11,662,191 B2
(45) Date of Patent: May 30, 2023

(54) TIME DELAY SYSTEMS, METHODS, AND DEVICES

(71) Applicant: Goodrich Corporation, Charlotte, NC (US)

(72) Inventors: Matthew D. Salois, Fairfield, CA (US); Luis G. Interiano, Galt, CA (US)

(73) Assignee: Goodrich Corporation, Charlotte, NC (US)

( * ) Notice: Subject to any disclaimer, the term of this patent is extended or adjusted under 35 U.S.C. 154(b) by 92 days.

(21) Appl. No.: 17/359,359

(22) Filed: Jun. 25, 2021

(65) Prior Publication Data

US 2022/0412711 A1 Dec. 29, 2022

(51) Int. Cl.
*F42C 9/06* (2006.01)

(52) U.S. Cl.
CPC ..... *F42C 9/06* (2013.01)

(58) Field of Classification Search
CPC .... F42C 9/10; F42C 9/12; F42C 15/18; F42C 15/184–196; F42C 15/31
USPC ..... 102/277
See application file for complete search history.

(56) References Cited

U.S. PATENT DOCUMENTS 2,807,210 A * 9/1957 Wales, Jr. ..... F42C 15/285 102/250
2,830,538 A * 4/1958 Dodge ..... F42B 23/16 102/404
2,963,974 A * 12/1960 Sekella ..... F42C 1/02 102/249
3,008,411 A 11/1961 Conrad
3,091,178 A * 5/1963 Ono ..... F42C 15/30 102/230
3,182,594 A 5/1965 Wilbur et al.
3,728,936 A * 4/1973 Norris ..... F42C 15/30 89/1.55
3,992,999 A * 11/1976 Chevrier ..... F42C 15/31 60/632
4,037,537 A 7/1977 Thorsell et al.
4,328,754 A * 5/1982 Goodman ..... F42C 9/06 102/277

(Continued)

FOREIGN PATENT DOCUMENTS

| | | |
|---|---|---|
| CN | 203550805 | 4/2014 |
| DE | 3005919 | 10/1981 |
| FR | 2594220 | 8/1987 |

OTHER PUBLICATIONS

USPTO; Notice of Allowance dated Oct. 27, 2022 in U.S. Appl. No. 17/496,490.

(Continued)

*Primary Examiner* — Samir Abdosh
(74) *Attorney, Agent, or Firm* — Snell & Wilmer L.L.P.

(57) ABSTRACT

A spring damper system for a pyrotechnic time delay may comprise: a piston; a firing pin; a hydraulic chamber, a portion of the piston disposed in the hydraulic chamber; and a first spring configured to compress in response to a time delay sequence being initiated, the piston configured to translate axially in the first axial direction in response to the first spring returning axially towards a neutral state, the first engagement end and the second engagement end configured to release in response to exiting the channel, and the firing pin configured to translate in the second axial direction in response to a second spring returning towards a second neutral state.

20 Claims, 5 Drawing Sheets

(56) References Cited

U.S. PATENT DOCUMENTS 5,843,895 A 12/1998 Lazarus et al.

OTHER PUBLICATIONS

European Patent Office, European Search Report dated Nov. 18, 2022 in Application No. 22170121.2.
European Patent Office, European Search Report dated Mar. 7, 2023 in Application No. 22200233.9.

* cited by examiner

TIME DELAY SYSTEMS, METHODS, AND DEVICES

FIELD

The present disclosure relates generally to time delay systems, methods and devices and, more particularly, to an inert time delay device with a spring damper system.

BACKGROUND

Energetic time delay systems and methods may have various manufacturing issues. Additionally, energetic time delay systems may include trial and error tests during verification and validation of a design and each production lot in order to determine the correct timing. Due to the inefficient process of design and manufacture of energetic time delay systems and methods, energetic time delay devices may be relatively expensive. Since the delay is created with energetics, there may be obsolescence issues. Additionally, energetic time delays may be a life limited part, resulting in additional cost of replacing the energetic time delay over the life of an asset, such as an aircraft or the like.

SUMMARY

A spring damper system for a pyrotechnic time delay is disclosed herein. The system may comprise: a piston having a piston head, a first rod extending in a first axial direction from the piston head, and a second rod extending in a second axial direction from the piston head, the second axial direction opposite the first axial direction, a first end of the second rod including a first engagement end; a firing pin comprising a head and a third rod extending axially from the head in the first axial direction, a second end of the third rod comprising a second engagement end, the second engagement end releasably coupled to the first engagement end in a channel, the channel configured to maintain engagement between the first engagement end and the second engagement end; a hydraulic chamber, the piston head disposed in the hydraulic chamber; and a first spring configured to compress in response to a time delay sequence being initiated, the piston configured to translate axially in the first axial direction in response to the first spring returning axially towards a neutral state, the first engagement end and the second engagement end configured to release in response to exiting the channel, and the firing pin configured to translate in the second axial direction in response to a second spring returning towards a second neutral state.

In various embodiments, the system further comprises a pressure plate disposed in a first chamber, the pressure plate configured to travel axially in the first chamber in the second axial direction, compress the first spring, and couple to the first rod in response to being receiving an axial force. The piston may be configured to translate in the first axial direction in response to the first spring extending in the first axial direction. The first spring may be configured to compress in the second axial direction and the second spring is configured to compress in the first axial direction. In various embodiments, the system further comprises a release chamber, wherein the release chamber has a first diameter greater than a second diameter of the channel. The first engagement end and the second engagement end may enter the release chamber in response to exiting the channel. The hydraulic chamber may include a working fluid. The piston head may travel axially in the hydraulic chamber through the working fluid. The working fluid may travel through the piston head from a first side of the piston head to a second side of the piston head.

An inert time delay device is disclosed herein. The inert time delay device may comprise: a housing having a first axial end and a second axial end; an ignition disposed at the first axial end; a primer disposed at the second axial end; a spring damper system disposed in the housing, the spring damper system comprising: a first spring disposed in a first chamber of the housing, the first chamber extending axially in a first axial direction from the ignition towards the second axial end; a second spring disposed in a second chamber of the housing, the second chamber extending axially in a second axial direction from the primer towards the first axial end; a piston comprising a piston head disposed between the first chamber and the second chamber; and a firing pin releasably coupled to the piston, the piston configured to travel axially in the second axial direction in response to the first spring returning from a first compressed state towards a first neutral state, the firing pin configured to disengage from the piston in response to a first engagement end of the piston and a second engagement end of the firing pin exiting a channel, the firing pin configured to travel axially in the first axial direction in response to the second spring returning from a second compressed state towards a second neutral state and initiating the primer.

In various embodiments, the device further comprises a hydraulic chamber disposed between the first chamber and the second chamber. The piston head may be disposed in the hydraulic chamber. The device may further comprise a pressure plate spaced apart from the ignition. The pressure plate may be configured to couple to the piston in response to travelling axially in the first axial direction and engaging a rod of the piston. The first spring may be compressed in response to the pressure plate travelling axially in the first axial direction. The device may further comprise a release chamber, the first engagement end and the second engagement end disposed in the channel, the first engagement end and the second engagement end configured to release in response to entering the release chamber from the channel.

A method of using an inert time delay device is disclosed herein. The method may further comprise: receiving, via the inert time delay device, a pressure in a first chamber in response to an ignition being activated; compressing, via a pressure plate in the inert time delay device, a first spring in a first axial direction in response to the pressure; translating, via a piston in the inert time delay device, in a second axial direction in response to the first spring returning towards a first neutral state; translating, via engagement between the piston and a firing pin in the inert time delay device, the firing pin in the second axial direction; compressing, via a head of the firing pin in the inert time delay device, a second spring in response to translating the firing pin in the second axial direction; releasing a first engagement end of the piston from a second engagement end of the firing pin in response to the first engagement end and the second engagement end exiting a channel into a release chamber; translating the firing pin in the first axial direction in response to the second spring returning towards a second neutral state; and igniting, via the firing pin in the inert time delay device, a primer in response to the firing pin contacting the primer.

In various embodiments, a piston head of the piston travels axially through a hydraulic chamber in response to translating in the second axial direction. The method may further comprise coupling the pressure plate to a rod of the piston prior to translating the piston in the second axial direction. The release chamber may have a first diameter that is greater than a second diameter of the channel.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Time delay devices for use with mines or demolition charges currently consist of cord type safety fuses, electric, electronic, and mechanical clocks, and chemical acting devices utilizing the corrosive effect of an acid on wire. Chemical type devices usually consist of a glass vial containing an acid mounted adjacent a spring loaded wire restraining a firing pin, such that when the vial is broken the acid spills over the wire and after the time delay taken for the wire to corrode through under the action of the acid the firing pin is released. However, these chemical devices are extremely sensitive to temperature and for the same device the time delay may vary between several hours to many days under varying conditions. Also, there is no indication how quickly the wire will break under the corrosive action and should the glass vial be subjected to internal damage the possibility that the wire will break almost immediately can lead to serious accidents in relation to personnel handling the devices.

Disclosed herein are time delay systems and methods utilizing a spring damper system. In various embodiments, the time delay system utilized a mechanical delay facilitated by a spring damper system instead of energetics. In various embodiments, a time delay device with the time delay system disclosed herein would be more efficient to manufacture and/or cost less relative to an energetic time delay device, in accordance with various embodiments.

Figure 1:
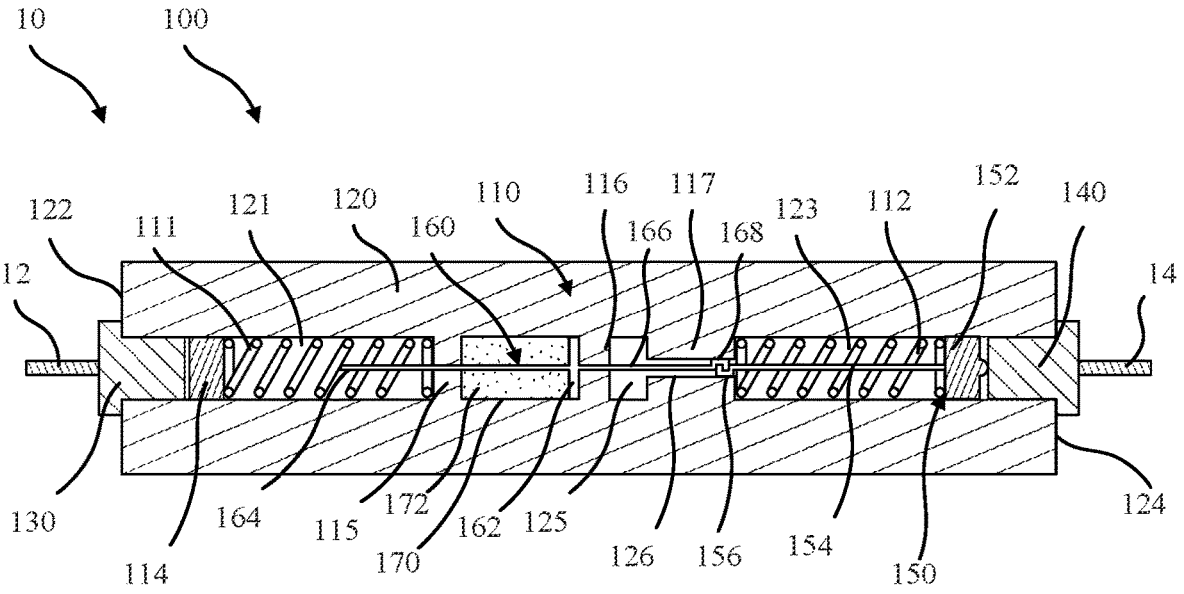
FIG. 1 illustrates a cross-sectional view of an inert time delay device with a spring damper system, in accordance with various embodiments.

Referring now to FIG. 1, a cross-sectional view of a portion of a pyrotechnic system 10 an inert time delay device 100 having a spring damper system 110 is illustrated, in accordance with various embodiments. The inert time delay device 100 is inert (i.e., chemically inactive), in accordance with various embodiments. In this regard, a life of the time delay system may be extended relative to typical time delay systems with pyrotechnic inputs and outputs.

In various embodiments, having the inert time delay device 100 is configured to couple to an input explosive transfer line (ETL) 12 and an output ETL 14. In this regard, the inert time delay device 100 is configured to generate a time delay from receiving an input signal from the input ETL to outputting a signal to the output ETL 14. In various embodiments, the inert time delay device 100 is adaptable for any pyrotechnic system configured for a predetermined time delay between an ETL being imitated and a firing device being initiated, such as demolition, fireworks, launch vehicle payload deployment systems, explosives in mining, or the like.

In various embodiments, the inert time delay device 100 comprises a housing 120 having a first end 122 and a second end 124, a low energy (LE) ignition 130, a primer 140, and the spring damper system 110. "Low energy ignition" or "gas generator ignition" as defined herein is a term of art referring to an ignition configured to generate a pressure front event at an output energy between 1 and 1000 Joules, or between 1 and 100 Joules, or approximately 10 Joules, in accordance with various embodiments.

In various embodiments, the LE or GG ignition 130 is disposed at the first end 122 of the housing 120 and the primer 140 is disposed at the second end 124 of the housing 120. The second end 124 is disposed opposite the first end 122. In various embodiments, the housing 120 may be cylindrical, cuboidal, or the like. The spring damper system 110 is disposed within the housing 120 and configured to generate a predetermined time delay from receiving an ignition at LE or GG ignition 130 at first end 122 and releasing a firing pin 150 into the primer 140 at second end 124.

In various embodiments, the spring damper system 110 comprises a first spring 111, a second spring 112, the firing pin 150, a piston 160, and a hydraulic chamber 170. The housing 120 comprises a first chamber 121, a second chamber 123, and the hydraulic chamber 170 disposed between the first chamber 121 and the second chamber 123. The housing 120 may further comprise a release chamber 125 disposed between the hydraulic chamber 170 and the second chamber 123.

In various embodiments, the first spring 111 is disposed between a pressure plate 114 and a first wall 115. The first wall 115 at least partially defines the first chamber 121 of the housing 120. The first chamber 121 is defined by an inner surface of the LE or GG ignition 130, a radially outer wall of the housing 120, and an axial wall (i.e., first wall 115) of the housing. The hydraulic chamber 170 is disposed axially between the first wall 115 and a second wall 116 disposed distal to the first wall 115

The pressure plate 114 is disposed proximate (i.e., spaced apart from), the LE or GG ignition 130. The first spring 111 may be disposed in a neutral state (i.e., neither compress nor extended). In various embodiments, in response to LE or GG ignition 130 being ignited, the LE or GG ignition 130 may generate a flame and pressure between the LE or GG ignition 130 and the pressure plate 114 in the first chamber 121. In various embodiments, as described further herein, the pressure generated from the LE or GG ignition 130 results in a force being applied on the pressure plate 114 towards the second end 124 of the housing 120, which results in the first spring 111 compressing and the pressure plate 114 translating axially towards the first wall 115.

In various embodiments, the piston 160 comprises a piston head 162, a first rod 164 and a second rod 166. The first rod 164 extends axially away from the piston head 162 toward the first end 122 of the housing 120. The second rod 166 extends axially away from the piston head 162 toward the second end 124 of the housing 120. In various embodiments, the piston head 162 is disposed in the hydraulic chamber 170. In this regard, the piston head 162 may further comprise apertures disposed therethrough to allow fluid communication between sides from one side of the piston head 162 to the other side of the piston head 162 during operation of the inert time delay device 100 as described further herein. In various embodiments, the piston 160 further comprises an engagement end 168 of the second rod 166 disposed distal to the piston head 162. In various embodiments, the first rod 164 extends through first wall 115 into the first chamber 121. Similarly, the second rod 166 extends through the second wall 116 into the second chamber 123.

In various embodiments, the hydraulic chamber 170 may be sealed from the first chamber 121 and the second chamber 123 by any method known in the art, such as an elastomeric seal, a gasket, or the like. In this regard, a working fluid 172 disposed in the hydraulic chamber 170 is configured is fluidly isolated from the first chamber 121 and the second chamber 123 during operation of the spring damper system 110. The working fluid 172 may be any working fluid, such as water, oil, air, or any other liquid or gas, etc. In various embodiments, the working fluid 172 may be chosen based on a desired viscosity and/or a desired predetermined time delay. In this regard, the structure of the inert time delay device 100 may be maintained and only a working fluid 172 may be changed to change a delay time from first delay time to a second delay time in accordance with various embodiments.

In various embodiments, the second spring 112 is disposed in the second chamber 123. The second spring 112 is disposed axially between a third wall 117 of the housing 120 and a head 152 of the firing pin 150. Similar to the first spring 111, the second spring 112 may be in a natural state (i.e., neither compressed nor extended) upon installation.

In various embodiments, the firing pin 150 comprises the head 152 disposed proximate (i.e., spaced apart from) the primer 140 and a rod 154 extending away from the head 152 towards the first end 122 of the housing. In various embodiments, the firing pin 150 further comprises an engagement end 156 disposed on an end of the rod 154 that is distal to the head 152. The engagement end 156 is configured to engage the engagement end 168 of second rod 166 of the piston 160.

The engagement end 168 of piston 160 and the engagement end 156 of the firing pin 150 may be disposed in a channel 126 disposed axially through the third wall 117 and extending from the release chamber 125. In this regard, the channel 126 may be sized and configured to maintain engagement between the engagement end 168 of the piston 160 and the engagement end 156 of the firing pin during operation, and the release chamber 125 may be sized and configured to facilitate disengagement between the engagement ends 156, 168 during operation of the spring damper system 110. In this regard, the release chamber 125 has a first diameter that is greater than a second diameter defined by the channel 126.

Figure 2:
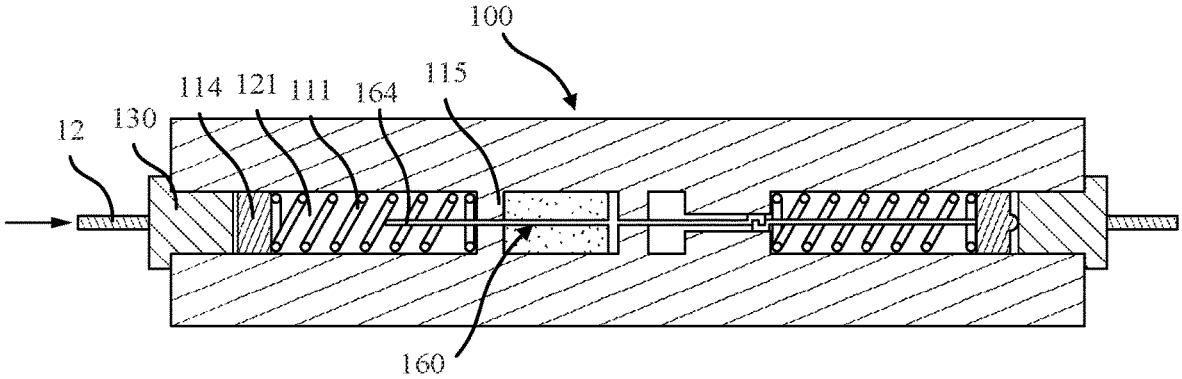
FIG. 2 illustrates a cross-sectional view of an inert time delay device with a spring damper system during use, in accordance with various embodiments.
Figure 3:
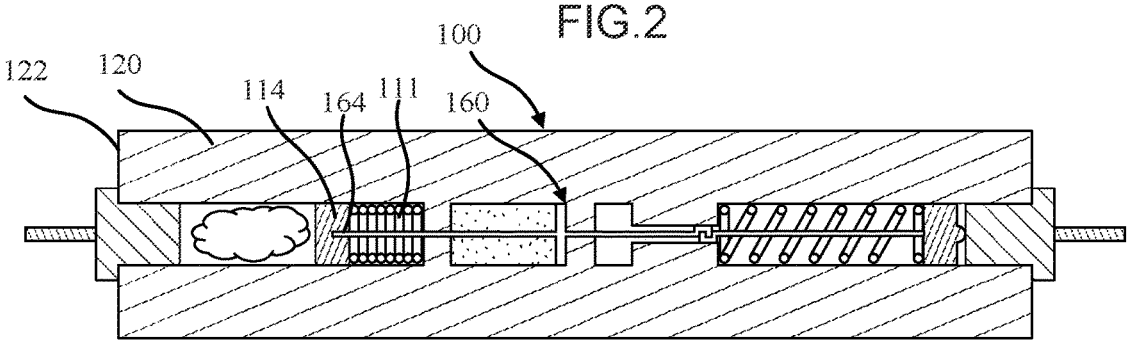
FIG. 3 illustrates a cross-sectional view of an inert time delay device with a spring damper system during use, in accordance with various embodiments.

Referring now to FIGS. 2 and 3, a cross-sectional view of an initial sequence of the inert time delay device 100 is illustrated, in accordance with various embodiments. As shown in FIG. 2, a time delay sequence is initiated in response to the LE or GG ignition 130 receiving a pyrotechnic input supplied via input ETL 12. In response to the LE or GG ignition 130 receiving the pyrotechnic input, the LE or GG ignition 130 may generate a low energy spark within the first chamber 121 between the pressure plate 114 and the LE or GG ignition 130. In this regard, the pressure the LE or GG ignition 130 and creates an axial force on pressure plate 114, causing the pressure plate to translate axially towards the first wall 115 and compress the first spring 111. In various embodiments, the pressure plate 114 is configured to engage, and become coupled to, the first rod 164 of the piston 160, as illustrated in FIG. 3. For example, the pressure plate 114 may comprise a receptacle configured to receive and lock to an end of the first rod 164. In various embodiments, the first spring 111 is in a compressed state upon engagement of the pressure plate 114 with the first rod 164 of the piston 160. Thus, once the force of the first spring 111 exceeds any remaining generated from the low energy spark of the LE or GG ignition 130, the first spring 111 translates the pressure plate 114, and the piston 160 axially towards the first end 122 of the housing 120 as illustrated in FIG. 4.

Figure 4:
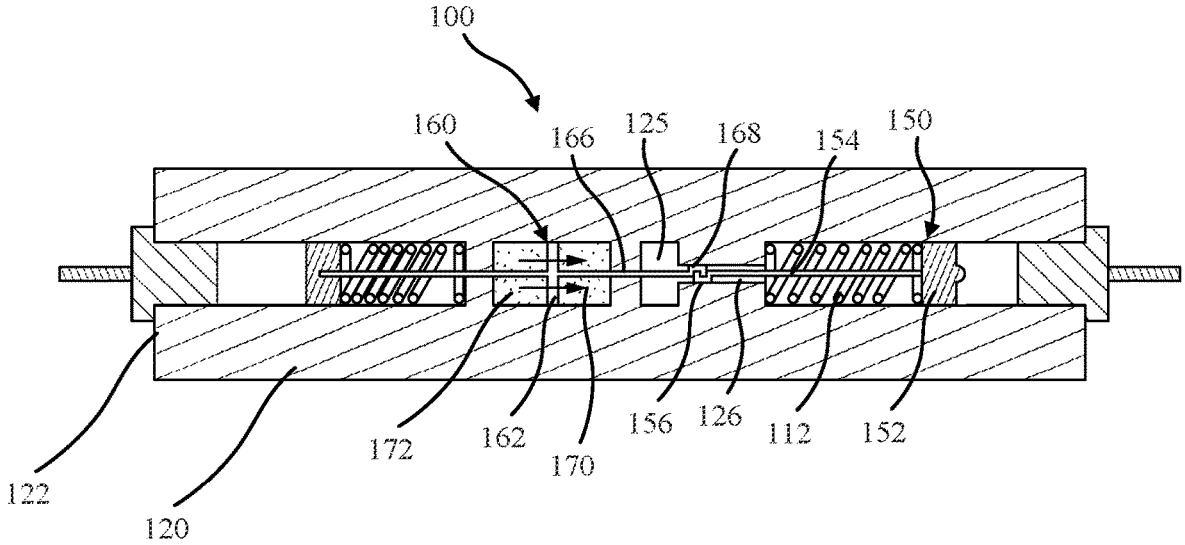
FIG. 4 illustrates a cross-sectional view of an inert time delay device with a spring damper system during use, in accordance with various embodiments.

With reference now to FIG. 4, in response to the piston 160 translating axially towards the first end 122 of the housing 120, the piston head 162 travels axially through the hydraulic chamber 170. In this regard, the piston 160 is dampened by the working fluid 172 in the hydraulic chamber 170. As mentioned previously herein, the working fluid may be chosen based on how long a specific application is seeking to delay the pyrotechnic signal. For example, a higher viscosity working fluid may be chosen for a longer delay relative to a lower viscosity fluid. As the piston head 162 travels axially through the hydraulic chamber 170, the working fluid may flow through the piston head 162 from one axial side of the piston head 162 to a second axial side of the piston head 162.

In various embodiments, in response to the piston 160 translating axially towards the first end 122 of the housing 120, the second rod 166 of the of the piston 160 pulls the rod 154 of the firing pin 150 through the channel 126 of the housing 120. In this regard, the engagement ends 156, 168 are pulled towards the release chamber 125 of the housing 120. In doing so, the head 152 of the firing pin 150 begins to compress the second spring 112, which begins to create stored potential energy within the second spring 112.

Figure 5:
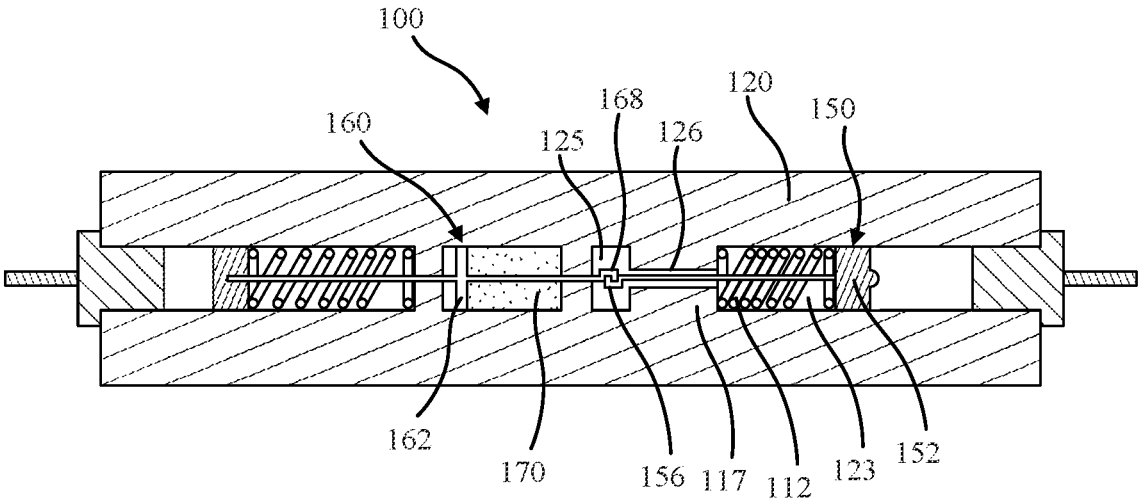
FIG. 5 illustrates a cross-sectional view of an inert time delay device with a spring damper system during use, in accordance with various embodiments.

Referring now to FIG. 5, in response to the piston head 162 of the piston 160 translating from a first axial side to a second axial side of the hydraulic chamber 170, the engagement ends 156, 168 enter the release chamber 125 of the housing 120. As mentioned previously herein, the release chamber 125 has a diameter that is greater than the channel 126 of the housing 120. In this regard, in response to the engagement ends 156, 168 entering the release chamber 125, the engagement ends 156, 168 are configured to disengage and release the firing pin 150 from the piston 160 as illustrated in FIG. 6, in accordance with various embodiments.

At the point of disengagement, the second spring 112 is compressed within the second chamber 123 between the head 152 of the firing pin 150 and an axial surface of the third wall 117. Due to the compression, the second spring 112 comprises stored energy, which is released in response to disengagement of the engagement ends 156, 168.

Figure 6:
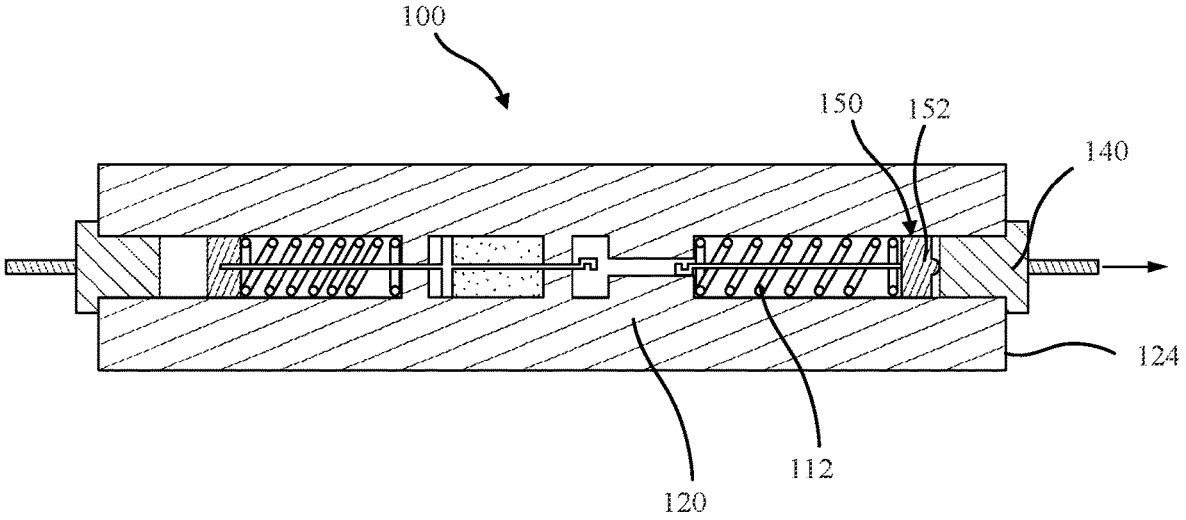
FIG. 6 illustrates a cross-sectional view of an inert time delay device with a spring damper system during use, in accordance with various embodiments.

Referring now to FIG. 6, the second spring 112 translated the firing pin 150 axially towards the second end 124 of the housing 120 causing the head 152 of the firing pin 150 to contact the primer 140 igniting a respective propellent in the primer 140, which in turn ignites an output ETL 14 and to complete a respective time delay.

In various embodiments, various aspects of the inert time delay device 100 may be sized and configured based on a predetermined time delay of the respective inert time delay device. For example, a spring having a specific spring constant may be varied in first spring 111 or second spring 112 to vary a respective time delay, a viscosity of working fluid 172 may be chosen based on a desired time delay, or the like. Similarly, an axial travel distance of the engagement ends 156, 168 may be varied or modified based on a desired time delay, or the like. In various embodiments, the mechanical aspects of the inert time delay device 100 may provide limited variations in a respective time delay compared to electronic time delay devices or other typical electronic device, in accordance with various embodiments. Similarly, due to the mechanical nature of the inert time delay device 100, less testing, and/or lower cost, relative to typical time delay devices may be achieved.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A spring damper system for a pyrotechnic time delay, comprising:

a piston having a piston head, a first rod extending in a first axial direction from the piston head, and a second rod extending in a second axial direction from the piston head, the second axial direction opposite the first axial direction, a first end of the second rod including a first engagement end;

a firing pin comprising a head and a third rod extending axially from the head in the first axial direction, a second end of the third rod comprising a second engagement end, the second engagement end releasably coupled to the first engagement end in a channel, the channel configured to maintain engagement between the first engagement end and the second engagement end;

a hydraulic chamber, the piston head disposed in the hydraulic chamber; and a first spring configured to compress in response to a time delay sequence being initiated, the piston configured to translate axially in the first axial direction in response to the first spring returning axially towards a neutral state, the first engagement end and the second engagement end configured to release in response to exiting the channel, and the firing pin configured to translate in the second axial direction in response to a second spring returning towards a second neutral state.

2. The spring damper system of claim 1, further comprising a pressure plate disposed in a first chamber, the pressure plate configured to travel axially in the first chamber in the second axial direction, compress the first spring, and couple to the first rod in response to being receiving an axial force.

3. The spring damper system of claim 2, wherein the piston configured to translate in the first axial direction in response to the first spring extending in the first axial direction.

4. The spring damper system of claim 1, wherein the first spring is configured to compress in the second axial direction and the second spring is configured to compress in the first axial direction.

5. The spring damper system of claim 1, further comprising a release chamber, wherein the release chamber has a first diameter greater than a second diameter of the channel.

6. The spring damper system of claim 5, wherein the first engagement end and the second engagement end enters the release chamber in response to exiting the channel.

7. The spring damper system of claim 1, wherein the hydraulic chamber includes a working fluid.

8. The spring damper system of claim 7, wherein the piston head travels axially in the hydraulic chamber through the working fluid.

9. The spring damper system of claim 8 wherein the working fluid travels through the piston head from a first side of the piston head to a second side of the piston head.

10. An inert time delay device, comprising:

a housing having a first axial end and a second axial end;

an ignition disposed at the first axial end;

a primer disposed at the second axial end;

a spring damper system disposed in the housing, the spring damper system comprising:

a first spring disposed in a first chamber of the housing, the first chamber extending axially in a first axial direction from the ignition towards the second axial end;

a second spring disposed in a second chamber of the housing, the second chamber extending axially in a second axial direction from the primer towards the first axial end;

a piston comprising a piston head disposed between the first chamber and the second chamber; and a firing pin releasably coupled to the piston, the piston configured to travel axially in the second axial direction in response to the first spring returning from a first compressed state towards a first neutral state, the firing pin configured to disengage from the piston in response to a first engagement end of the piston and a second engagement end of the firing pin exiting a channel, the firing pin configured to travel axially in the first axial direction in response to the second spring returning from a second compressed state towards a second neutral state and initiating the primer.

11. The inert time delay device of claim 10, further comprising a hydraulic chamber disposed between the first chamber and the second chamber.

12. The inert time delay device of claim 11, wherein the piston head is disposed in the hydraulic chamber.

13. The inert time delay device of claim 10, further comprising a pressure plate spaced apart from the ignition.

14. The inert time delay device of claim 13, wherein the pressure plate is configured to couple to the piston in response to travelling axially in the first axial direction and engaging a rod of the piston.

15. The inert time delay device of claim 14, wherein the first spring is compressed in response to the pressure plate travelling axially in the first axial direction.

16. The inert time delay device of claim 10, further comprising a release chamber, the first engagement end and the second engagement end disposed in the channel, the first engagement end and the second engagement end configured to release in response to entering the release chamber from the channel.

17. A method of using an inert time delay device, the method comprising:

receiving, via the inert time delay device, a pressure in a first chamber in response to an ignition being activated;

compressing, via a pressure plate in the inert time delay device, a first spring in a first axial direction in response to the pressure;

translating, via a piston in the inert time delay device, in a second axial direction in response to the first spring returning towards a first neutral state;

translating, via engagement between the piston and a firing pin in the inert time delay device, the firing pin in the second axial direction;

compressing, via a head of the firing pin in the inert time delay device, a second spring in response to translating the firing pin in the second axial direction;

releasing a first engagement end of the piston from a second engagement end of the firing pin in response to the first engagement end and the second engagement end exiting a channel into a release chamber;

translating the firing pin in the first axial direction in response to the second spring returning towards a second neutral state; and igniting, via the firing pin in the inert time delay device, a primer in response to the firing pin contacting the primer.

18. The method of claim 17, wherein a piston head of the piston travels axially through a hydraulic chamber in response to translating in the second axial direction.

19. The method of claim 17, further comprising coupling the pressure plate to a rod of the piston prior to translating the piston in the second axial direction.

20. The method of claim 17, wherein the release chamber has a first diameter that is greater than a second diameter of the channel.

* * * * *